US010270199B2

(12) United States Patent
Cheng et al.

(10) Patent No.: US 10,270,199 B2
(45) Date of Patent: Apr. 23, 2019

(54) POWER CONNECTOR

(71) Applicant: ALLTOP ELECTRONICS (SUZHOU) LTD., Suzhou, Jiangsu Province (CN)

(72) Inventors: Ihung Cheng, New Taipei (TW); Siumien Yang, New Taipei (TW); Ruihong Liu, Suzhou (CN)

(73) Assignee: ALLTOP ELECTRONICS (SUZHOU) LTD., Suzhou, Jiangsu Province (CN)

( * ) Notice: Subject to any disclaimer, the term of this patent is extended or adjusted under 35 U.S.C. 154(b) by 0 days.

(21) Appl. No.: 15/745,119

(22) PCT Filed: Aug. 18, 2017

(86) PCT No.: PCT/CN2017/098144
§ 371 (c)(1),
(2) Date: Jan. 15, 2018

(87) PCT Pub. No.: WO2018/137340
PCT Pub. Date: Aug. 2, 2018

(65) Prior Publication Data

US 2019/0020142 A1 Jan. 17, 2019

(30) Foreign Application Priority Data

Jan. 24, 2017 (CN) ..... 2017 1 0055108

(51) Int. Cl.
*H01R 13/428* (2006.01)
*H01R 13/426* (2006.01)
(Continued)

(52) U.S. Cl.
CPC ..... *H01R 13/426* (2013.01); *H01R 13/02* (2013.01); *H01R 13/46* (2013.01); *H01R 43/20* (2013.01)

(58) Field of Classification Search
CPC ..... H01R 13/426; H01R 13/02; H01R 13/11; H01R 13/28; H01R 13/113;
(Continued)

(56) References Cited

U.S. PATENT DOCUMENTS 7,488,188 B2 * 2/2009 Moriyama ..... H01R 13/26 439/108
7,976,317 B2 * 7/2011 Patel ..... H01R 12/7088 439/699.1
(Continued)

FOREIGN PATENT DOCUMENTS

CN 201142414 Y 10/2008
CN 102299442 A 12/2011
(Continued)

*Primary Examiner* — Jean F Duverne
(74) *Attorney, Agent, or Firm* — Cheng-Ju Chiang

(57) ABSTRACT

A power connector includes an insulative housing, a plurality of power contact pairs retained in the insulative housing abreast along a transverse direction and a plurality of parallel fasteners. The insulative housing has a plurality of receiving slots arranged side by side along the transverse direction. Each power contact pair defines a pair of power contacts opposite to each other, and each parallel fastener is connecting the pair of power contacts of each power contact pair mechanically and electrically together. The insulative housing defines a plurality of accommodating grooves, and each accommodating groove is located behind and communicated with the corresponding receiving slot, each parallel fastener is locked in the corresponding accommodating groove and fixing the corresponding power contact pair in the accommodating groove.

20 Claims, 14 Drawing Sheets

(51) Int. Cl.
*H01R 13/02* (2006.01)
*H01R 43/20* (2006.01)
*H01R 13/46* (2006.01)

(58) Field of Classification Search
CPC ..... H01R 13/6682; H01R 13/08; H01R 13/6471; H01R 13/6585; H01R 12/7088; H01R 13/26; H01R 13/46
See application file for complete search history.

(56) References Cited

U.S. PATENT DOCUMENTS

| | | | | |
|---|---|---|---|---|
| 8,007,322 | B2 * | 8/2011 | Okuyama | H01R 13/6585 439/607.08 |
| 8,047,875 | B2 * | 11/2011 | Yamakami | H01R 13/6471 439/660 |
| 8,398,433 | B1 * | 3/2013 | Yang | H01R 31/08 439/108 |
| 8,444,438 | B2 * | 5/2013 | Gao | H01R 13/6582 439/607.35 |
| 2006/0003620 | A1 * | 1/2006 | Daily | H01R 13/113 439/295 |
| 2007/0275586 | A1 * | 11/2007 | Ngo | H01R 13/28 439/290 |
| 2012/0164892 | A1 * | 6/2012 | Ke | H01R 13/11 439/676 |
| 2013/0171856 | A1 | 7/2013 | Tai et al. | |

FOREIGN PATENT DOCUMENTS

| | | | |
|---|---|---|---|
| CN | 106299808 | A | 1/2017 |
| CN | 206180192 | U | 5/2017 |
| CN | 106848707 | A | 6/2017 |
| TW | 201347313 | A | 11/2013 |

* cited by examiner

FIG. 1 (Prior Art)

POWER CONNECTOR

CROSS REFERENCE OF THE RELATED APPLICATIONS

This application is a 35 U.S.C. § 371 National Phase conversion of International (PCT) Patent Application No. PCT/CN2017/098144, filed on Aug. 18, 2017, which claims priority of the Chinese Patent Application No. 201710055108.4, filed on Jan. 24, 2017 and with the titled of "power connector", which is incorporated herein by reference in its entirety. The PCT International Patent Application was filed in Chinese.

BACKGROUND OF THE INVENTION

Field of the Invention

The present invention relates to a power connector, and more particularly to a power connector having higher strength power contact pair and parallel fastener.

Description of Related Art

A power connector is usually used for power transmission, and a conventional power connector usually includes a plurality of or a single power contact and an insulator holding the power contacts. The plurality of power contacts are connected with each other in parallel by a contact bus bar, to provide large current transmission.

FIG. 1 illustrates an existing power connector 900 comprising an insulative housing 91, a plurality of power contact pair 92 retained in the insulative housing 91 and a number of parallel fastener 93. The insulative housing 91 defines a plurality of contact receiving channels arranged along a transverse direction, and each power contact is retained in the corresponding contact receiving channel via a pair of elastic tabs on both sides thereof. A pair of mounting holes are defined in relative supporting portions of each power contact pair 92, and aligning along a front-and-back direction. An exterior terminal is connected with each power contact pair 92 through a screw or a dowel pin.

However, as the parallel fastener 93 only locking with the power contact pair by a screw or a dowel pin, the parallel fastener may be cracked if the locking force is oversize; and the peripheral portion of the mounting holes of the power contact pair 92 is unable to withstand greater locking force. In addition, when the power contact pair connected with higher current cable, the power contact pair and the relative parallel fastener can't be supported and can't bear the whole weight of the higher current cable, and the supporting portion 924 of the power contact pair may have a risk of pulling up or cracking while the cable being pulled.

Hence, it is desired to provide a power connector to overcome the problems mentioned above.

BRIEF SUMMARY OF THE INVENTION

Accordingly, an object of the present invention is to provide a power connector having higher strength power contact pair and parallel fastener.

The present invention is directed to a power connector comprising an insulative housing, a plurality of power contact pairs retained in the insulative housing abreast along a transverse direction and a plurality of parallel fasteners. The insulative housing has a plurality of receiving slots arranged side by side along the transverse direction. Each power contact pair defines a pair of power contacts opposite to each other, and each parallel fastener is connecting the pair of power contacts of each power contact pair mechanically and electrically together. The insulative housing defines a plurality of accommodating grooves, and each accommodating groove is located behind and communicated with the corresponding receiving slot, each parallel fastener is locked in the corresponding accommodating groove and fixing the corresponding power contact pair in the accommodating groove, each parallel fastener has a main portion and a protrusion extruding backwards from the main portion, and the protrusion has a smaller width than the main portion along the transverse direction.

As further improvement of the present invention, each power contact pair has a pair of contacting sheets opposite to each other, a rear supporting portion and a pair of conjoining portions connecting the corresponding contacting sheet with the supporting portion respectively, the supporting portion is connected with each conjoining portion to form an L-shaped structure.

As further improvement of the present invention, the contacting sheets of each power contact pair are located in the relative receiving slot, the conjoining portions and the supporting portion are received in the relative accommodating groove, the relative parallel fastener is abutting against an upper surface of the pair of the conjoining portion.

As further improvement of the present invention, the insulative housing has a mating surface, a rear face and a mounting surface between the mating surface and the rear face.

The insulative housing comprises a plurality of partition walls located between the mounting surface and the rear face and arranged separating from each other along the transverse direction, a pair of limiting walls are protruding towards each other from two opposite faces of each two neighboring partition walls, each accommodating groove is formed by two relative limiting walls, the relative mounting surface and two neighboring partition walls fencing together.

As further improvement of the present invention, two opposite limiting walls are located on lateral sides of the corresponding protrusion along the transverse direction, thereby locking with the protrusion.

As further improvement of the present invention, a pair of bumps are projecting outwards from relative lateral surface of the protrusion, and each one of the pair of limiting walls defines a latch mechanism locking with the corresponding bump.

As further improvement of the present invention, a latching slot of each limiting wall is extending along a front-and-back direction and served as the latch mechanism.

As further improvement of the present invention, the protrusion of each parallel fastener defines a pair of ribs on both sides thereof, and the ribs are extruding outwards from the relative side face along the transverse direction, the ribs are extending along a fixing direction of the parallel fastener and connected with a relative bump, each limiting wall has a positioning slot for the rib and the bump being inserted into, and the rib is received in the relative positioning slot.

As further improvement of the present invention, each positioning slot is extending along a vertical direction and in cross communicated with the relative latching slot.

As further improvement of the present invention, an elastic arm is extending along a fixing direction of the parallel fastener 4" and served as the latching mechanism.

As further improvement of the present invention, the protrusion has a flange on an upper side of a rear face thereof, and the flange is extending along the transverse direction and located on the supporting portion to prevent the supporting portion moving upwards.

As further improvement of the present invention, the protrusion has a convex portion on the rear face further, and the convex portion is received in an indentation of the supporting portion.

The present invention is also directed to a power connector comprising an insulative housing having a plurality of receiving slots abreast arranged along a transverse direction and a plurality of accommodating grooves, a plurality of power contact pairs assembled into the relative receiving slot along a first direction, and a plurality of parallel fasteners assembled into the corresponding accommodating groove along a second direction perpendicular to the first direction. Each accommodating groove is located behind and communicated with the corresponding receiving slot, each parallel fastener is locked in the corresponding accommodating groove and abutting against the corresponding power contact pair to prevent the power contact pair being pulled up and avoid deformation.

As further improvement of the present invention, each power contact pair has a pair of contacting sheets opposite to each other, a rear supporting portion and a pair of conjoining portions connecting the corresponding contacting sheet with the supporting portion respectively, the supporting portion is connected with each conjoining portion to form an L-shaped structure.

As further improvement of the present invention, each parallel fastener is abutting against an upper surface of the pair of the conjoining portions, and a rear surface of the parallel fastener is abutting against a front surface of the supporting portion, a flange of the parallel fastener is located on the supporting portion.

As further improvement of the present invention, the insulative housing comprises a plurality of partition walls arranged separating from each other along the transverse direction, and a pair of limiting walls are protruding towards each other from two opposite faces of each two neighboring partition walls for locking with the relative parallel fastener.

As further improvement of the present invention, a pair of bumps are projecting outwards from relative lateral surface of the parallel fastener, and each one of the pair of limiting walls defines a latch mechanism locking with the corresponding bump.

The present invention is also directed to a power connector comprising an insulative housing having a plurality of receiving slots abreast arranged along a transverse direction, a plurality of power contact pairs assembled into the corresponding receiving slots, and a plurality of parallel fasteners abutting against the relative power contact pairs and locking with the insulative housing for retaining the power contact pairs in the relative slots. Each power contact pair has a pair of contacting sheets opposite to each other, a rear supporting portion and a pair of conjoining portions connecting the corresponding contacting sheet with the supporting portion respectively. Each parallel fastener has a main portion, a protrusion extruding backwards from the main portion and an inserting portion below the main portion and the protrusion, the inserting portion has a smaller width than the main portion and the protrusion along the transverse direction for inserting into a space room of the pair of conjoining portions.

As further improvement of the present invention, a linking face is formed on a conjunction area between the inserting portion connecting with the main portion and the protrusion, and the linking face is facing downwards to abut against an upper surface of the pair of the conjoining portions.

As further improvement of the present invention, the protrusion has a flange on an upper side of a rear face thereof, and the flange is located on the supporting portion.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
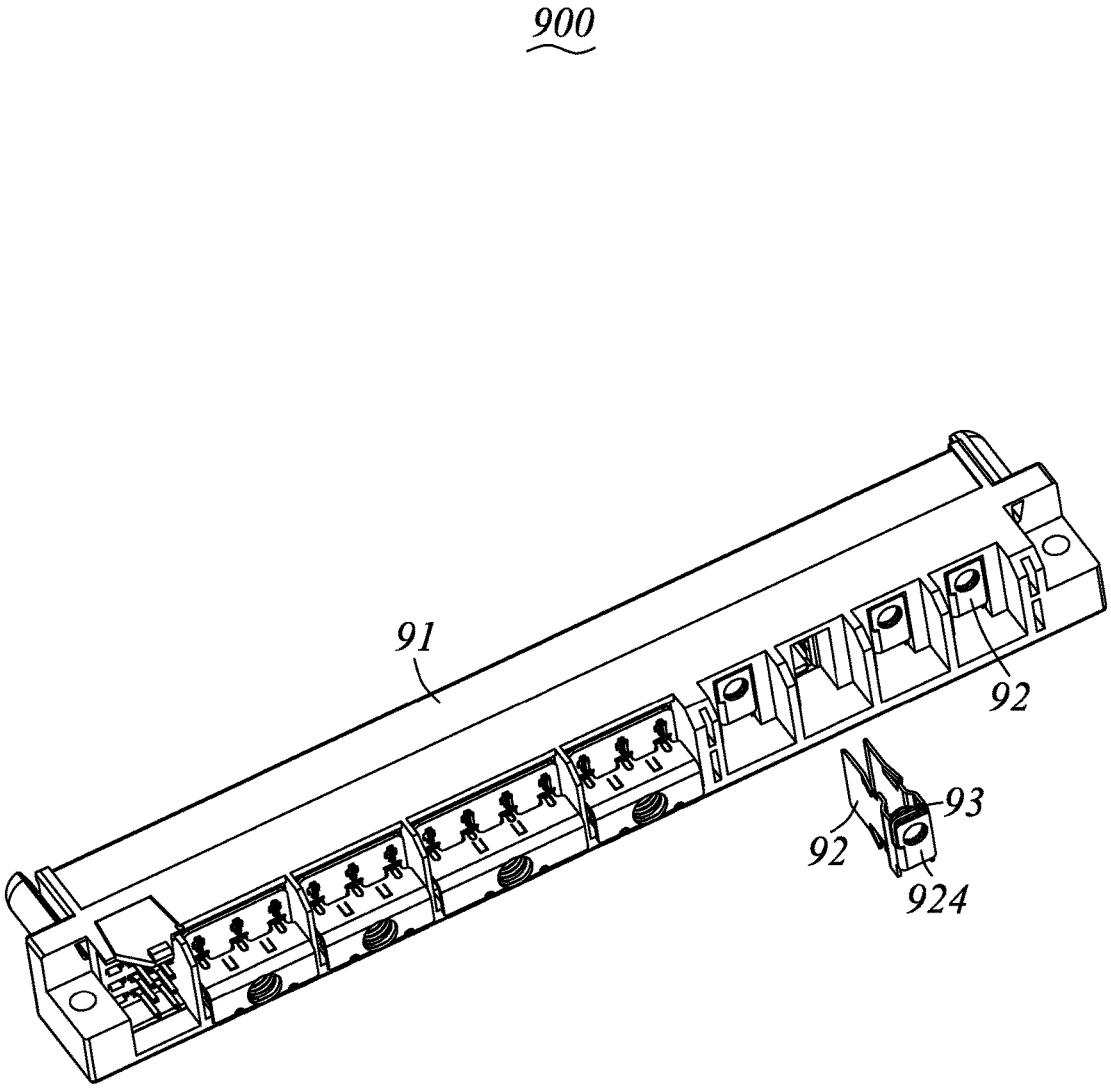
FIG. 1 is a perspective view of an existing power connector.

Reference will be made to the drawing figures to describe the present invention in detail, wherein depicted elements are not necessarily shown to scale and wherein like of similar elements are designated by same or similar reference numeral through the several views and same or similar terminology.

Please refer to FIG. 2 to FIG. 10, showing a first exemplary embodiment of power connector 100 in present invention, the power connector 100 comprises an insulative housing 1, a plurality of power contact pairs 2, a plurality of signal contact 3 and a plurality of parallel fasteners 4, each power contact pair 2 is mechanically and electrically connected with an exterior terminal (not shown) via a corresponding parallel fastener 4.

Figure 2:
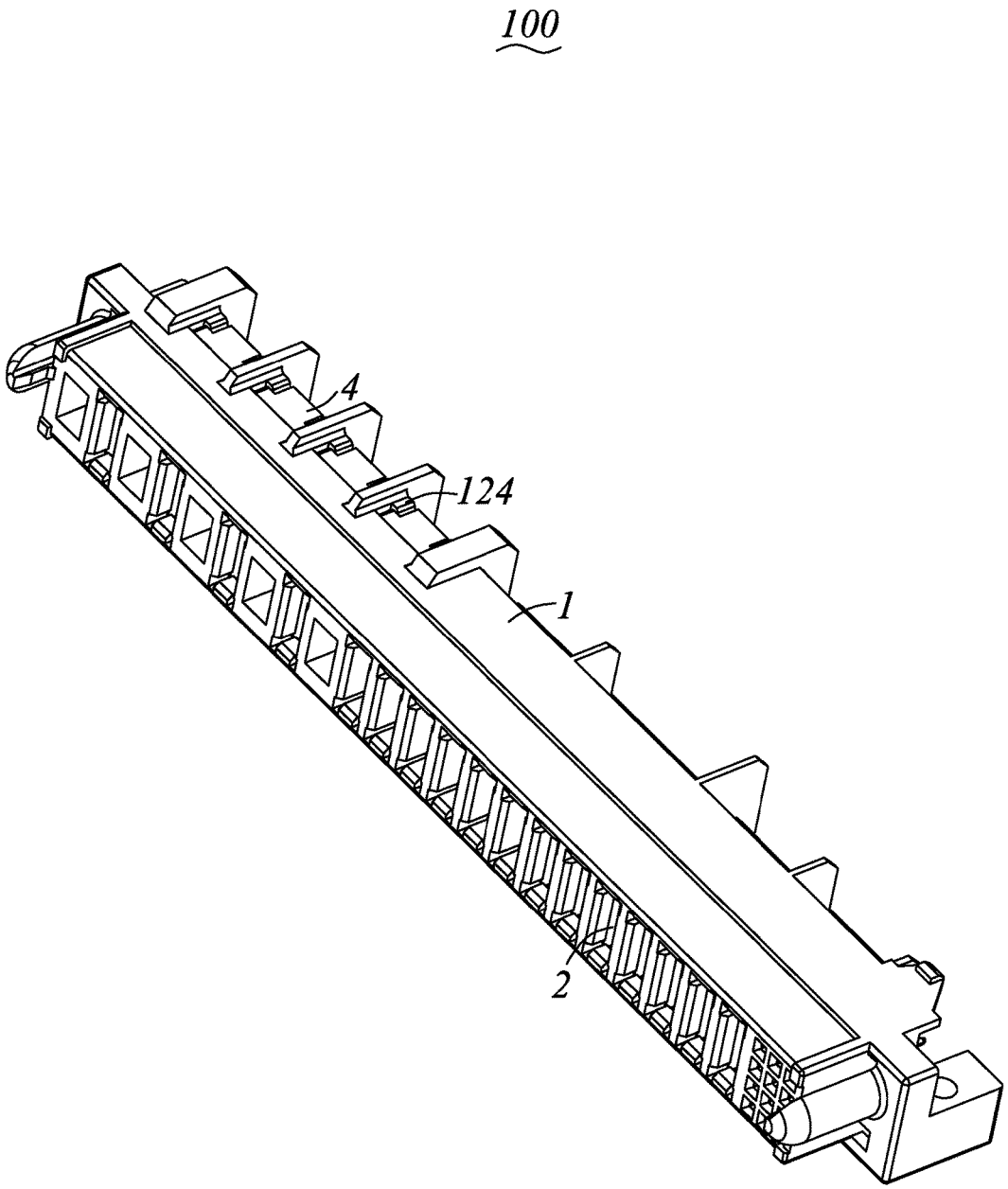
FIG. 2 is an assembled perspective view of a power connector in accordance with a first illustrated embodiment of the present invention.
Figure 3:
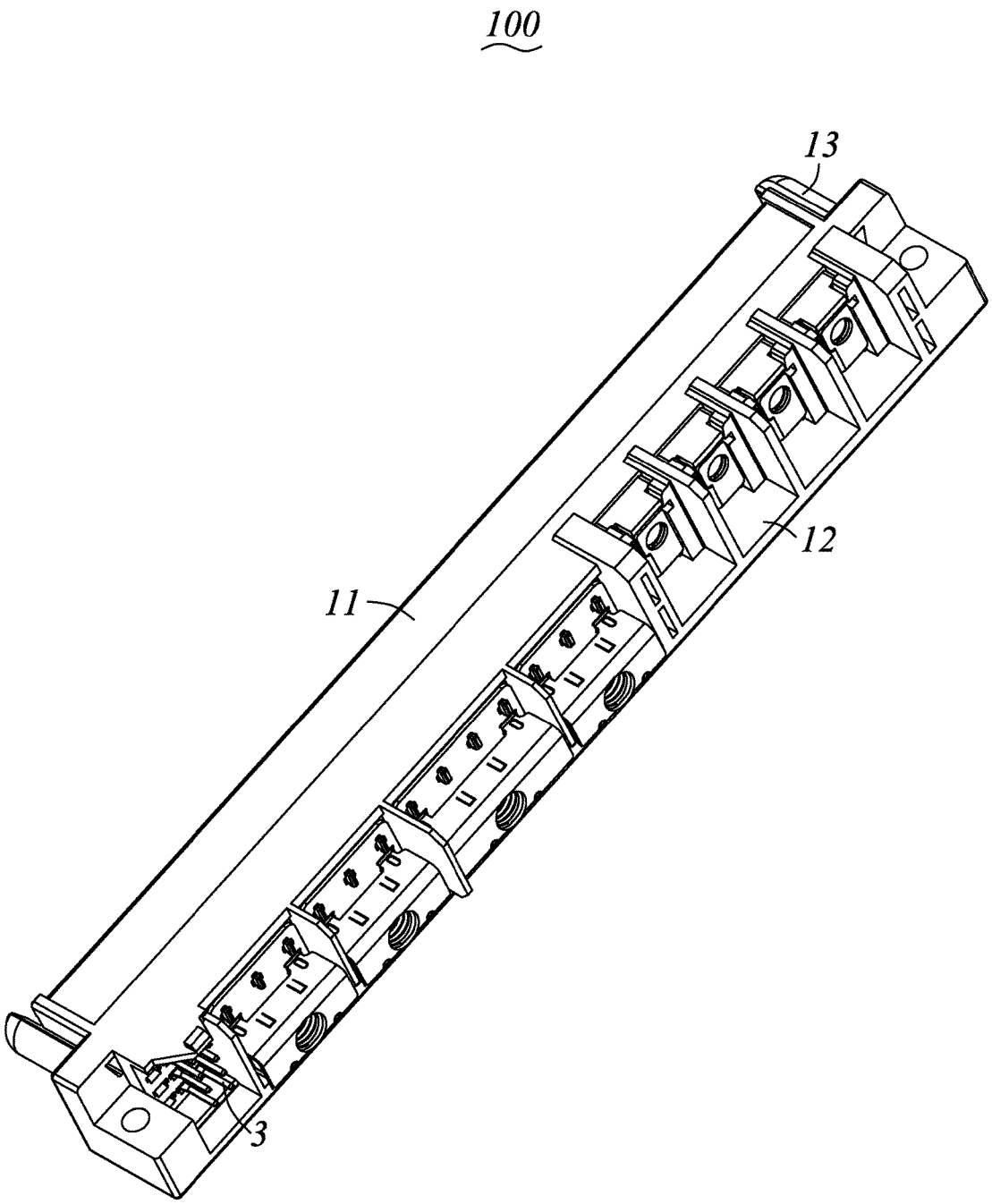
FIG. 3 is similar to FIG. 2, but shown from a different aspect.
Figure 4:
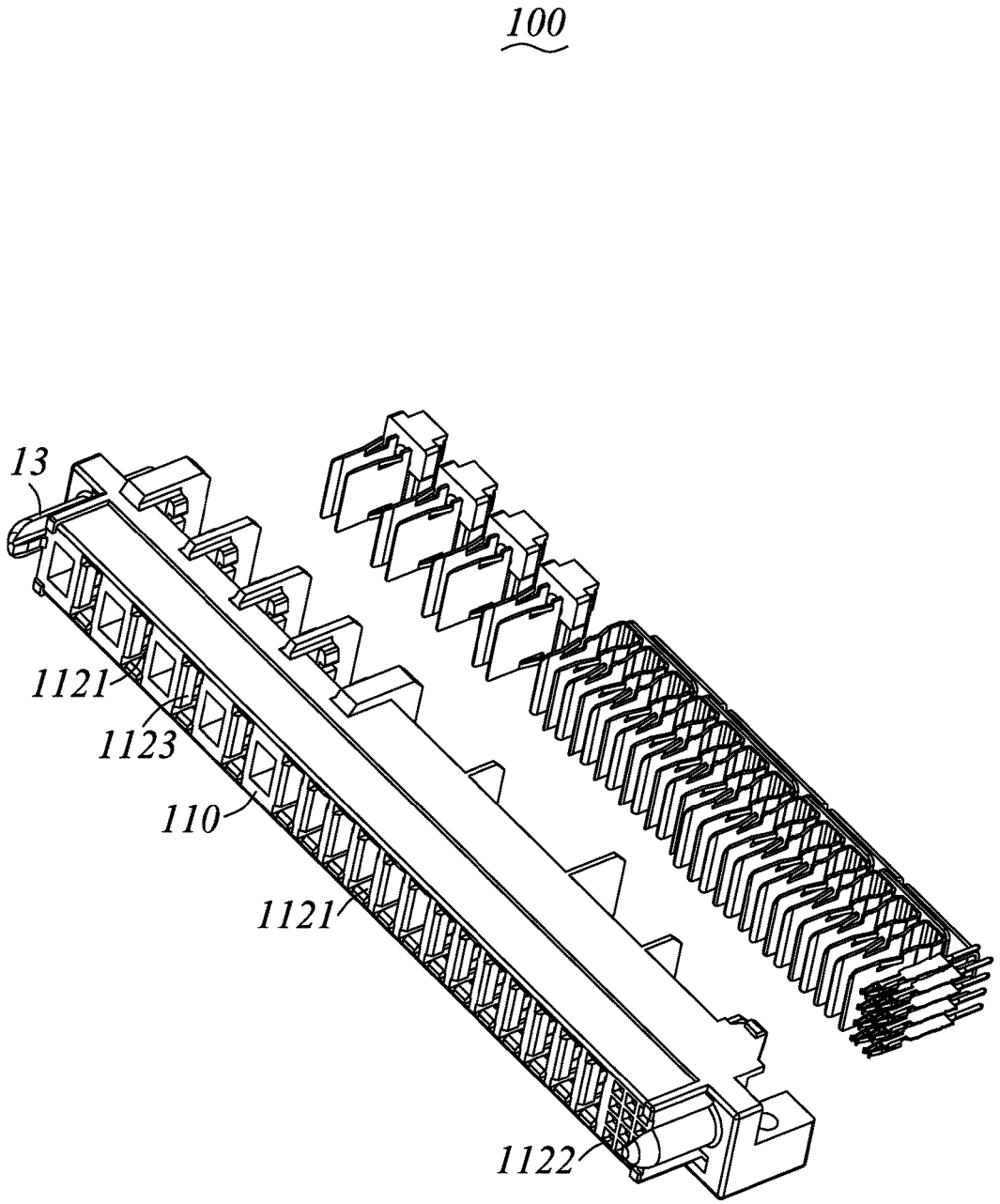
FIG. 4 is a partially exploded view of the power connector shown in FIG. 2.
Figure 5:
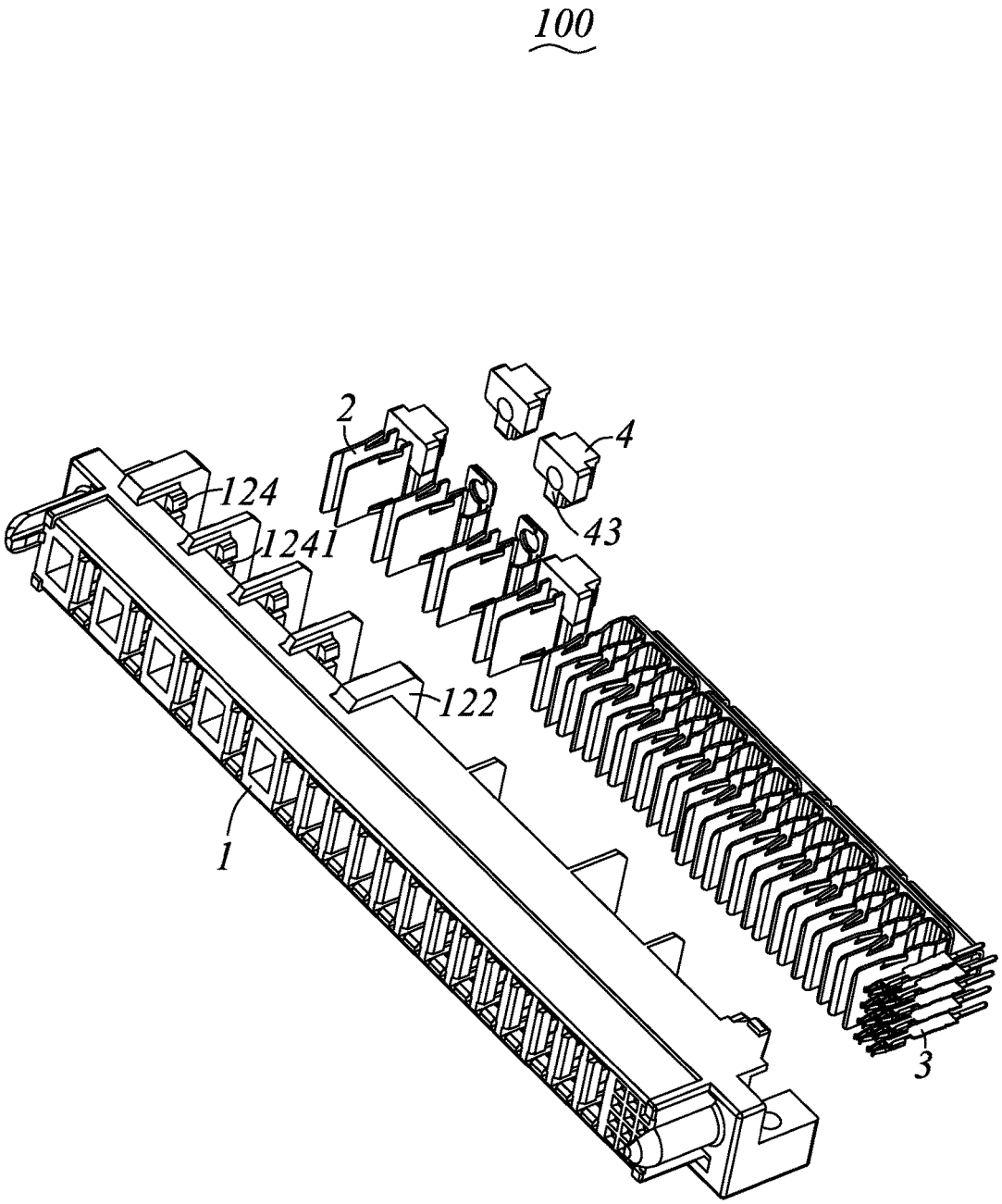
FIG. 5 is a further exploded view of the power connector shown in FIG. 4.
Figure 6:
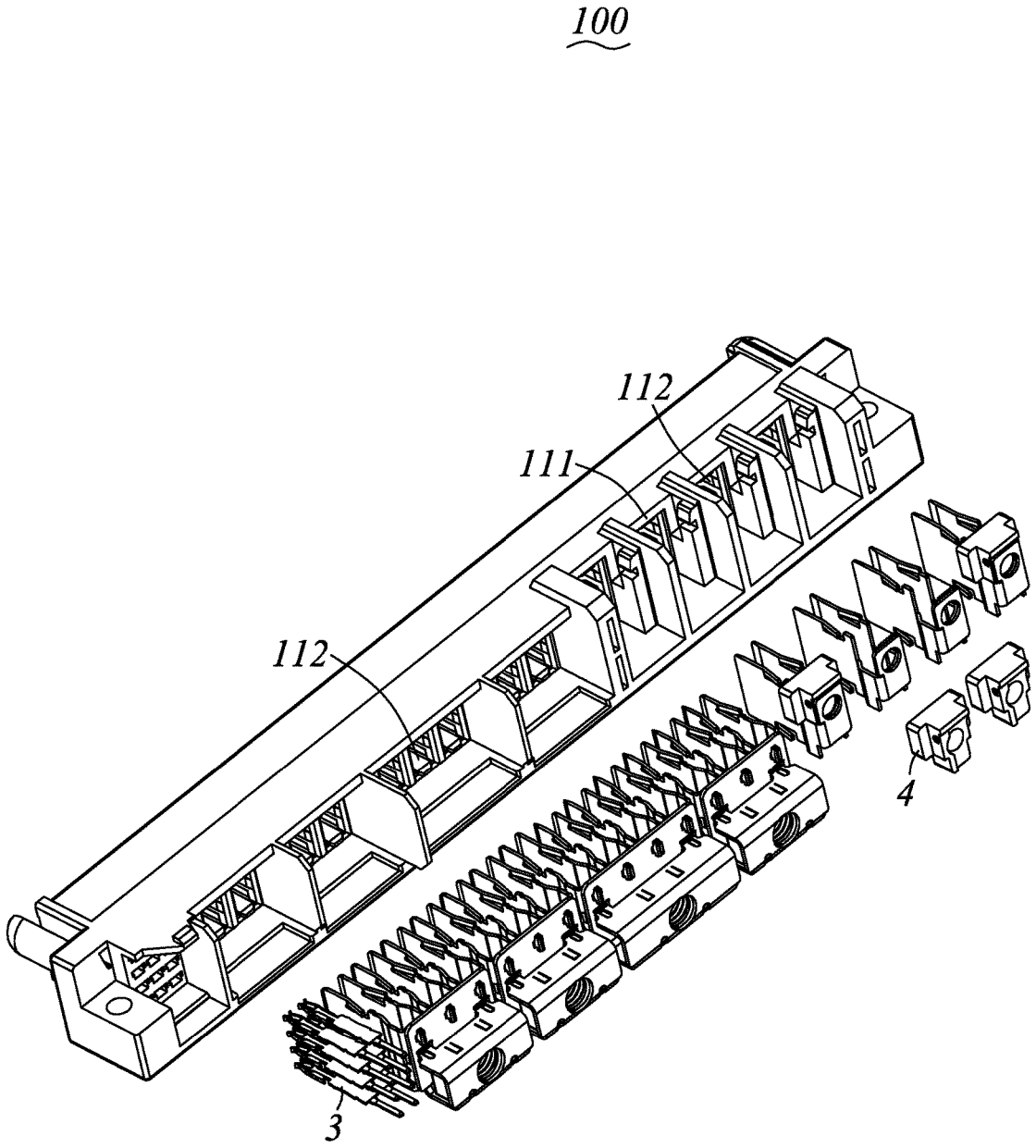
FIG. 6 is similar to FIG. 5, but shown from a different aspect.
Figure 7:
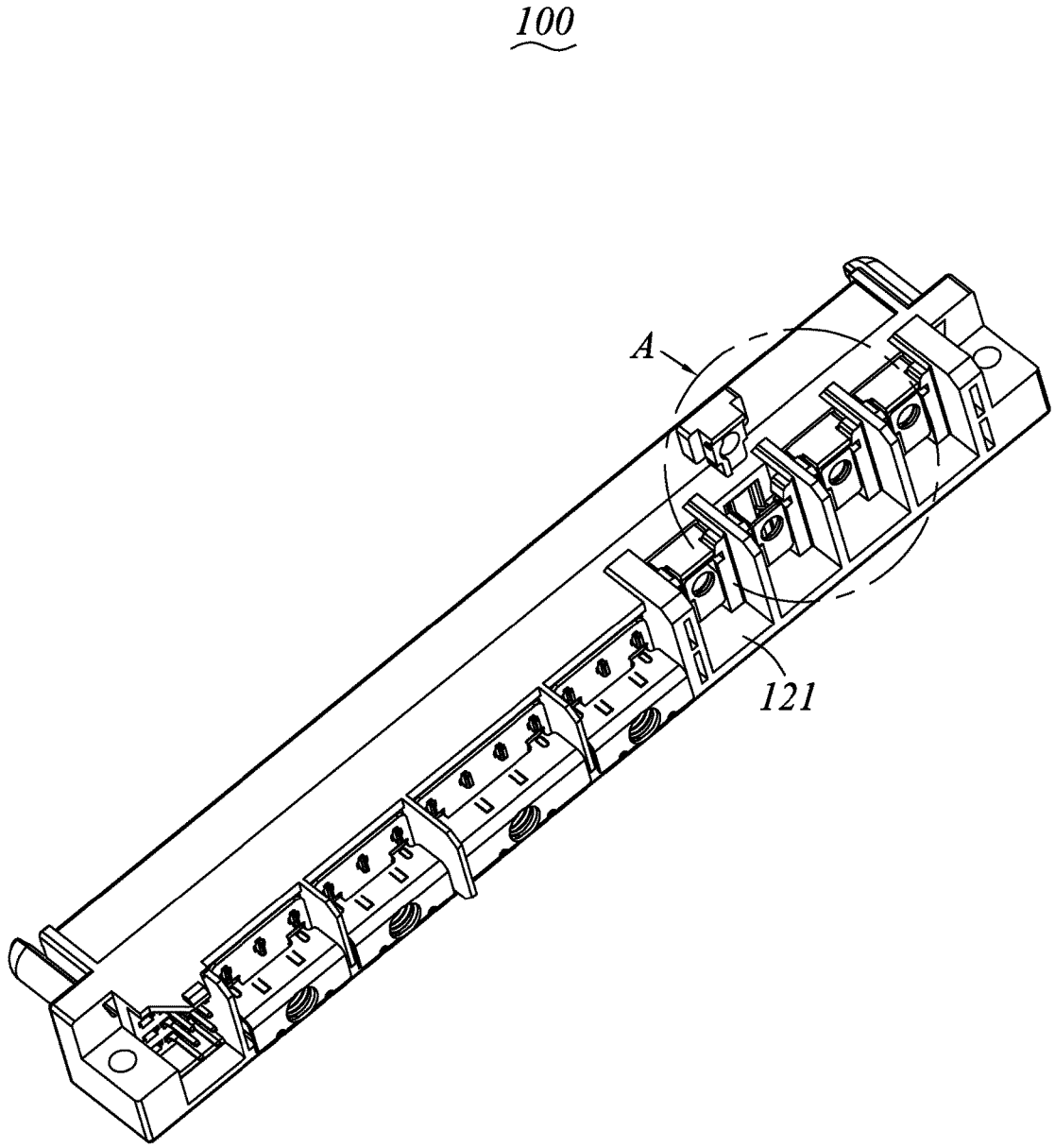
FIG. 7 and FIG. 8 are partially assembled perspective views of the power connector shown in FIG. 6.
Figure 8:
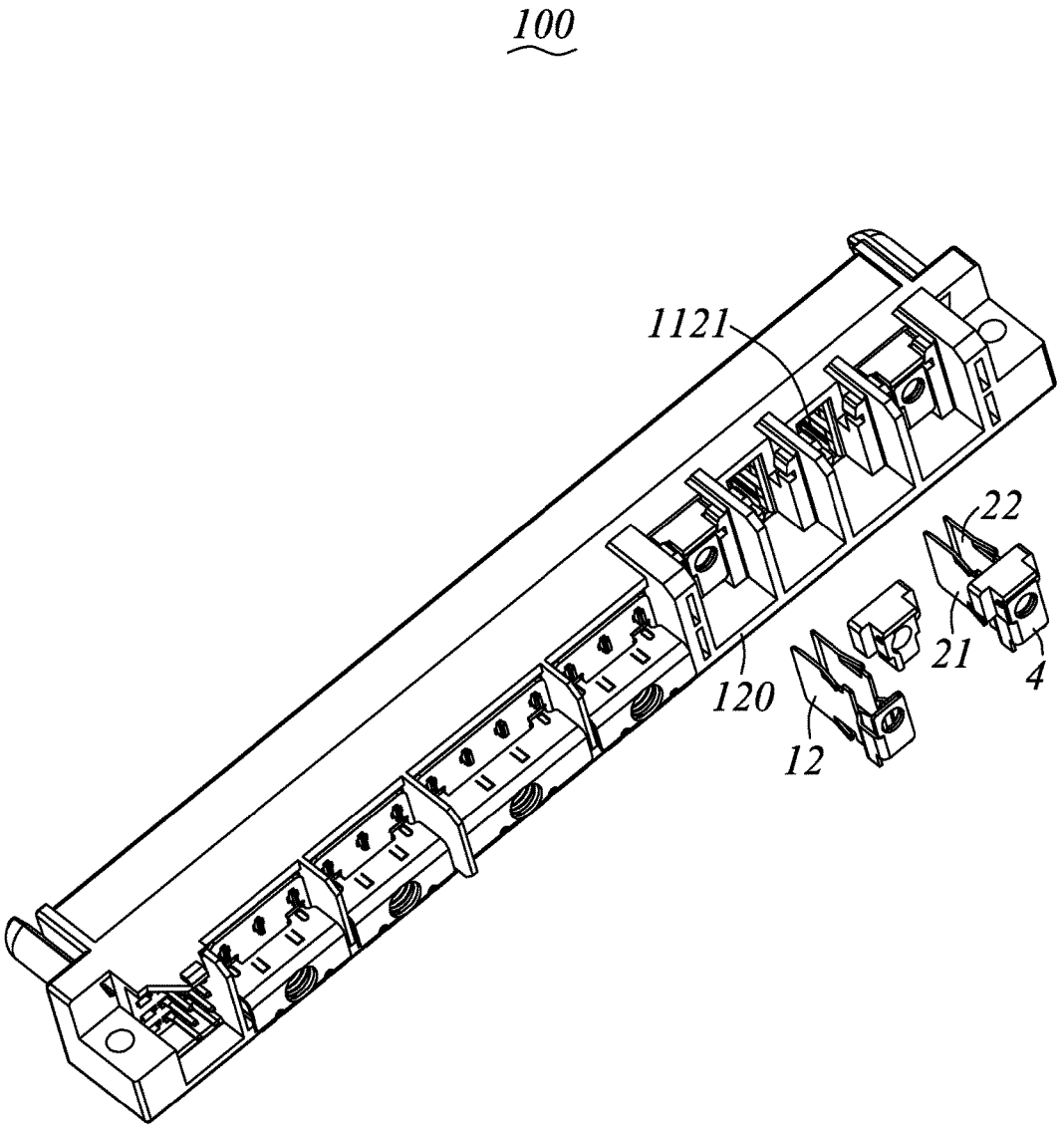
Figure 9:
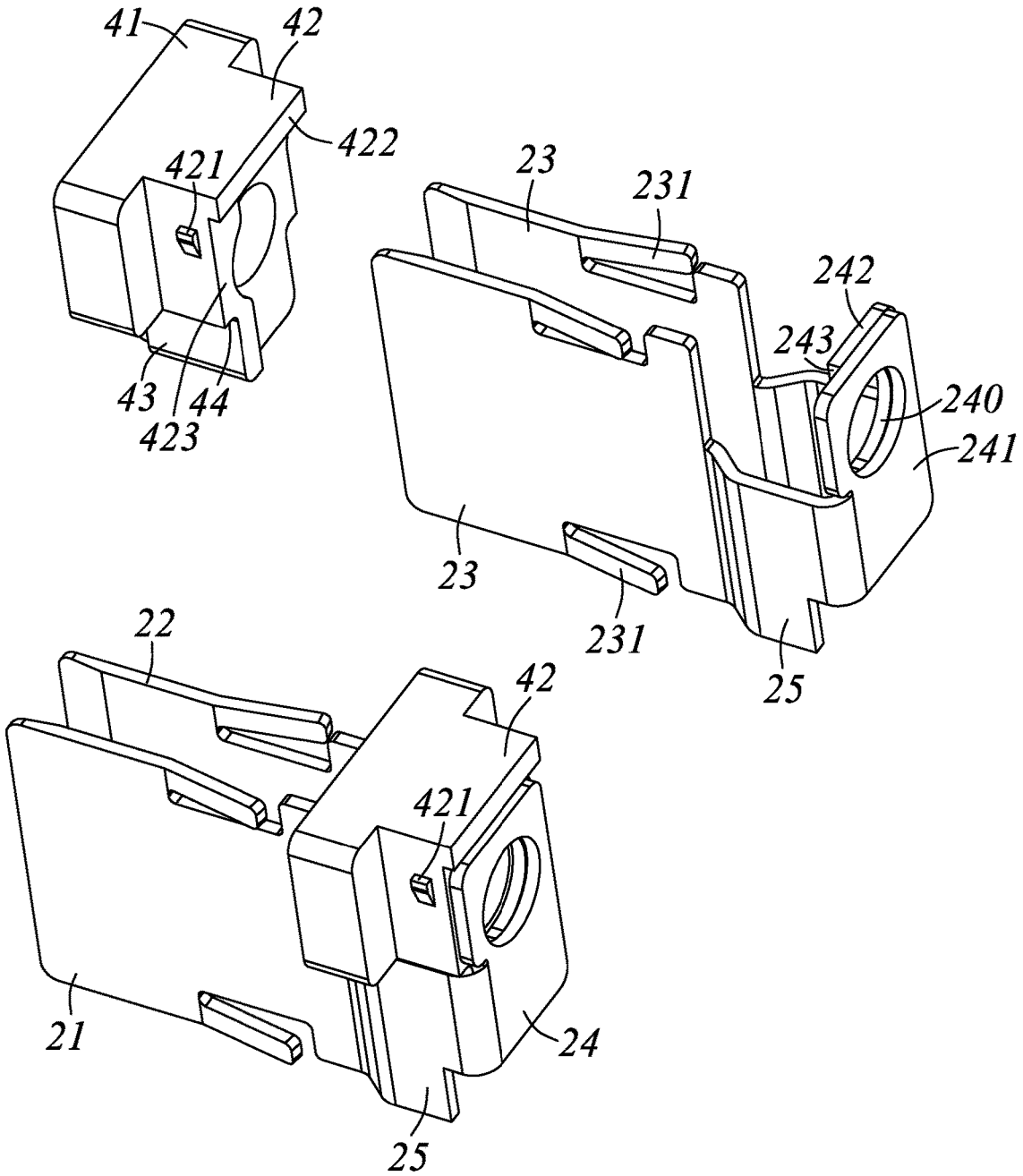
FIG. 9 is a perspective view of two power contact pairs and two parallel fasteners of the power connector shown in FIG. 8.
Figure 10:
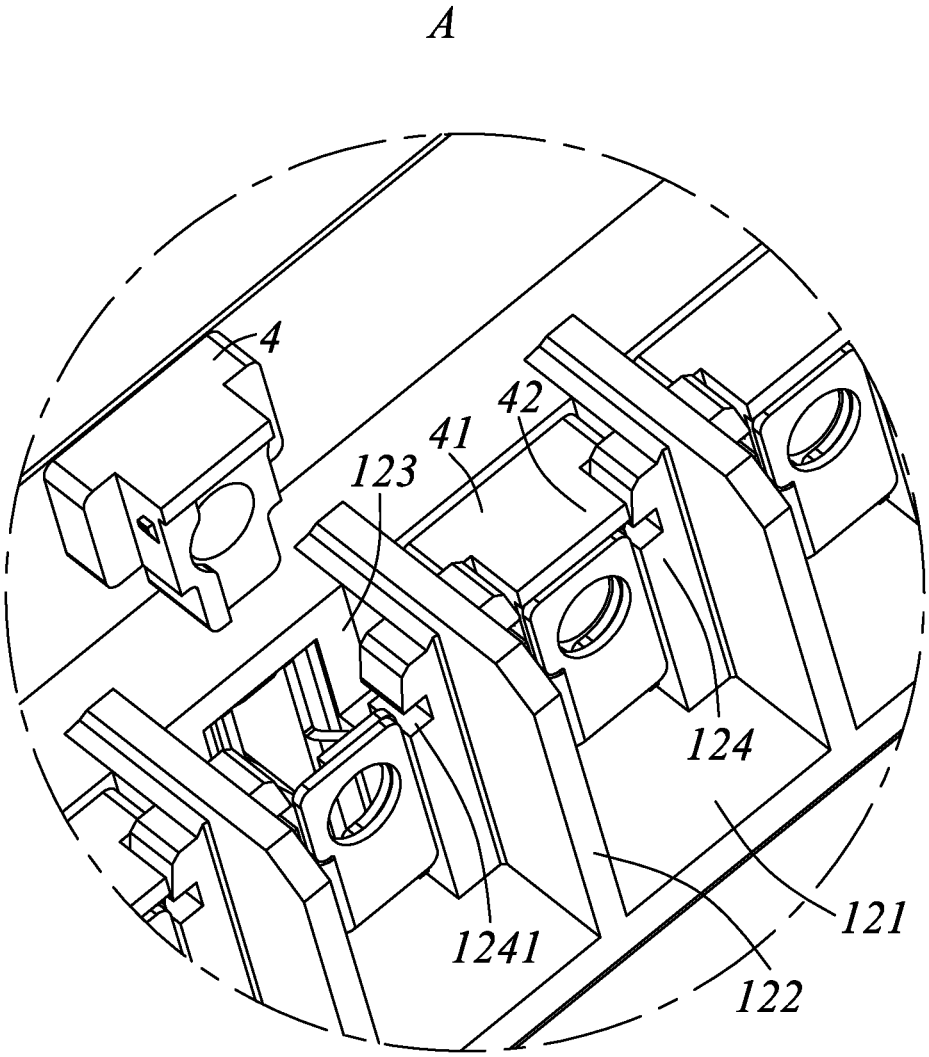
FIG. 10 is an enlarged view of part A in FIG. 7.

Referring to FIG. 2 to FIG. 4, the insulative housing 1 comprises a base portion 11, an extension portion 12 and a pair of guiding posts 13. The extension portion 12 extends backwards from the base portion 11 along a mating direction plugged with a complementary connector (not shown), the guiding posts 13 are located on both sides of a front section of the base portion 11 along a transverse direction, for guiding a plug connection with the complementary connector.

The base portion 11 defines a front mating surface 110 mating with the complementary connector, a rear mounting surface 111 and a plurality of receiving slots 112 along a front-and-back direction. The receiving slots 112 are recessed from the mating surface 110 to the mounting surface 111. In the preferred embodiment, the receiving slots 112 include a plurality of power contact receiving slots 1121 and a plurality of signal contact receiving slots 1122. The power contact receiving slots 1121 are arranged side by side along the transverse direction of the insulative housing 1, and the signal contact receiving slots 1122 are defined on one side of the power contact receiving slots 1121. A pair of limiting portions 1123 are arranged in a front end of each power contact receiving slot 1122 symmetrically, and the limiting portions 1123 are protruding towards each other.

The extension portion 12 has a rear face 120 behind the mounting surface 111, and comprises a bottom wall 121 extending backwards from a lower section of the base portion 11 and a plurality of partition walls 122 extending backwards from the mounting surface 111. The bottom wall 121 is connected with the partition walls 122, and each partition wall 122 protrudes upwards to make an upper surface thereof higher than a front section of the extension portion 12. The partition walls 122 are located between the mounting surface 111 and the rear face 120, and arranged separating from each other along the transverse direction. The extension portion 12 of the insulative housing 1 also has a plurality of accommodating grooves 123, and each accommodating groove 123 is located behind and communicated with the corresponding power contact receiving slot 1121.

A pair of limiting walls 124 are protruding towards each other from two opposite faces of each two neighboring partition walls 122. Each accommodating groove 123 is formed by two relative limiting walls 124, the relative mounting surface 111 and two neighboring partition walls 122 fencing together, thus the accommodating groove 123 is of T-shaped from an overhead view.

Referring to FIG. 2 to FIG. 5, the power connector 100 has seventeen power contact pairs 2 held in the corresponding power contact receiving slots 1121, and there is a one-to-one correspondence between the power contact pair 2 and the power contact receiving slot 1121. Each power contact pair 2 includes a pair of power contacts opposite to each other, to make the description more clearly, we can illustrate the pair of power contacts respectively as a first contact 21 and a second contact 22.

In the present embodiment, the power contact pairs 2 are divided into three groups which comprise a first group, a second group and a plurality of third groups. Each power contact pair 2 of the second group and the third group has a configuration different from each power contact pair 2 of the first group, of course in an alternative embodiment, they can be set with a same configuration. Each power contact pair 2 of the second group has a configuration same as that of the third group.

Each power contact pair 2 of the first group has a pair of contacting sheets 23 opposite to each other, a rear supporting portion 24 and a pair of conjoining portions 25 connecting the corresponding contacting sheet 23 with the supporting portion 24 respectively, the supporting portion 24 is connected with each conjoining portion 25 to form an L-shaped structure. The pair of contacting sheets 23 of every power contact pair 2 are housed in a same power contact receiving slot 1121 together. Each contacting sheet 23 defines a pair of resisting tabs 231 at upper and lower edges thereof, and the resisting tabs 231 is formed by tearing outwardly. A front end of the contacting sheet 23 resists the relative limiting portion 1123 to prevent the power contact pair 2 from moving forwardly.

A first supporting portion 241 of the first contact 21 and a second supporting portion 242 of the opposite second contact 22 are stacked along the front-and-back direction to form the corresponding supporting portion 24. Each supporting portion 24 has a mounting hole 240 penetrating through thereof along the front-and-back direction. The first supporting portion 241 and the second supporting portion 242 are connected with the corresponding conjoining portions 25, and the second supporting portion 242 has a smaller size than the first supporting portion 241 along the transverse direction, thus an indentation 243 is formed in front of the first supporting portion. In other alternative embodiments, the first supporting portion 241 and the second supporting portion 242 can have no difference of transverse size, and an indentation 243 is not existed.

Each parallel fastener 4 has a main portion 41, a protrusion 42 extruding backwards from the main portion 41 and an inserting portion 43 below the main portion 41 and the protrusion 42. The protrusion 42 has a smaller width than the main portion 41 along the transverse direction, looked at from above, each parallel fastener 4 is of T-shaped as a whole, to enhance the strength of the parallel fastener 4 itself, and the parallel fastener 4 is not cracked when too large torsion locking force is exerted to. The inserting portion 43 has a smaller width than the main portion 41 and the protrusion 42 along the transverse direction, thus a linking face 44 is formed on a conjunction area between the inserting portion 43 connecting with the main portion 41 and the protrusion 42, and the linking face 44 is facing downwards. Each parallel fastener 4 also has a fixing hole 45 penetrating through thereof along the front-and-back direction.

A pair of bumps 421 are projecting outwards from relative lateral surface of the protrusion 42, and the pair of bumps 421 are defined on both sides of the protrusion 42 symmetrically. The protrusion 42 has a flange 422 on an upper side of a rear face thereof and a convex portion 423 on the rear face, the flange 422 is extending along the transverse direction and projecting backwards to form a strip configuration. The convex portion 423 is connected with a lower surface of the flange 422, and located on one side of the protrusion 42 along the transverse direction. Further, the convex portion 423 is extending downwards from the lower surface of the flange 422 until a lower surface of the convex portion 423 coplanar with a bottom face of the inserting portion 43, and the extension direction of the flange 422 is perpendicular to the extension direction of the convex portion 423.

When the power contact pairs 2 are received in the relative power contact receiving slots 1121, the contacting sheets 23 of each power contact pair 2 are located in the relative power contact receiving slot 1121, the conjoining portions 25 and the supporting portion 24 are received in the relative accommodating groove 123. Each parallel fastener 4 is assembled into the relative accommodating groove 123 along an up-to-down direction and locked in the accommodating groove 123, thus the power contact pair 2 can be retained.

Further, the linking face 44 of each parallel fastener 4 is abutting against an upper surface of the pair of the conjoining portions 25, so that the main portion 41 and the protrusion 42 are settled on the conjoining portions 25. The mounting hole 240 of the supporting portion 24 is aligning with the fixing hole 45 of the parallel fastener 4 along the front-and-back direction, for an exterior fixing member inserting and locking. A rear surface of the protrusion 42 is parallel to the supporting portion 24, and abutting against a front surface of the supporting portion 24. The flange 422 is located on the supporting portion 24 to prevent the supporting portion 24 moving upwards. The convex portion 423 of the parallel fastener 4 is received in the indentation 243 of the supporting portion 24, to limit the transverse movement of the second supporting portion 242 further.

Two opposite limiting walls 124 are located on lateral sides of the corresponding protrusion 42 along the transverse direction, thereby locking with the protrusion 42. Each one of the pair of limiting walls 124 defines a latch mechanism locking with the corresponding bump 421. In present embodiment, a latching slot 1241 of each limiting wall 124 is extending along the front-and-back direction and served as the latch mechanism, to lock with the corresponding bump 421 therein, thus the parallel fastener 4 is positioned in the accommodating groove 123, and can't fall of when unlocked. When the exterior terminal is pulled, the parallel fastener 4 can withstand greater pulling force and will not be pulled up. In addition, the supporting portion 24 of each power contact pair 2 is connected with the corresponding conjoining portion 25 to form an L-shaped configuration, thus the parallel fastener 4 is suppressing on the corresponding pair of conjoining portions 25, and an accessorial fixation of the parallel fastener 4 can be achieved.

Figure 11:
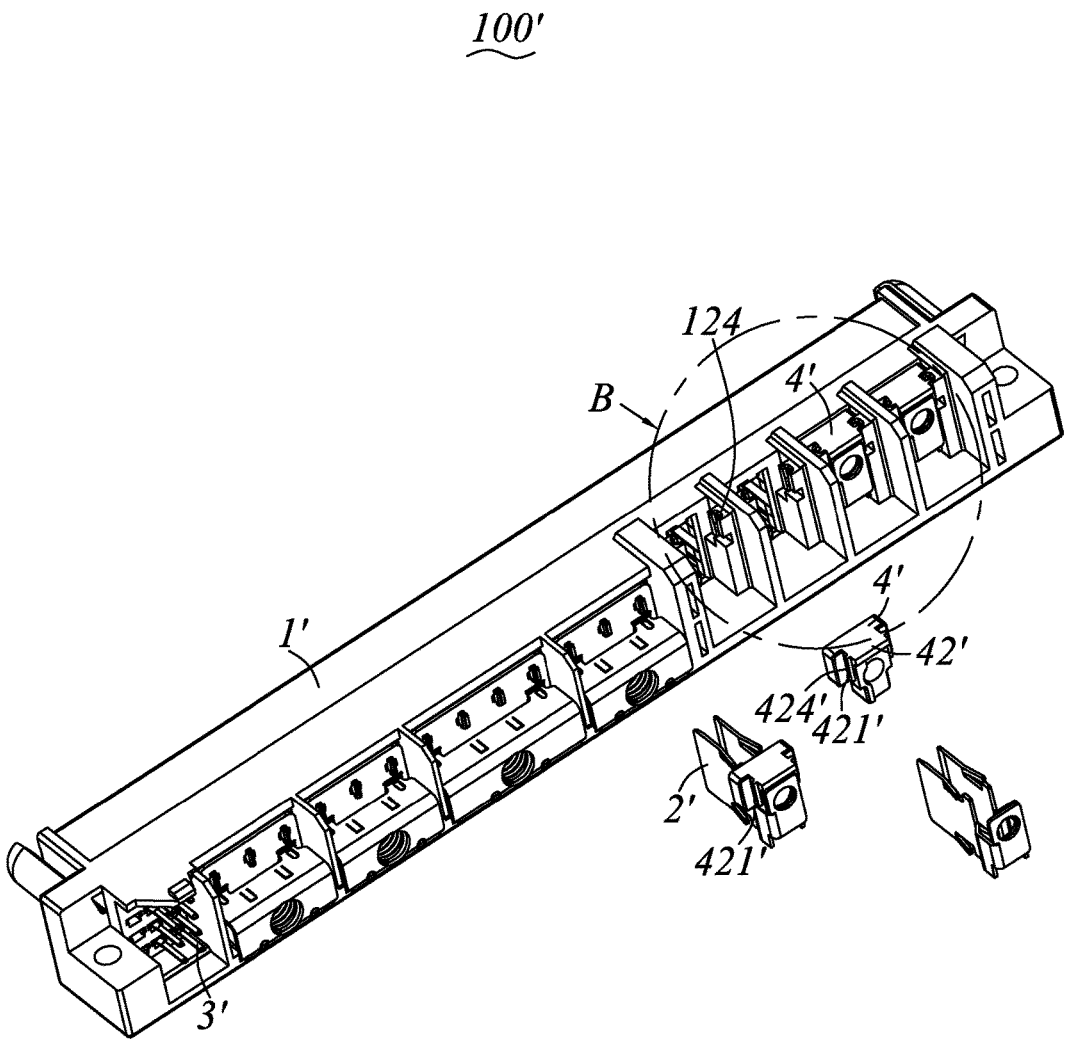
FIG. 11 is a perspective view of a power connector in accordance with a second illustrated embodiment of the present invention.
Figure 12:
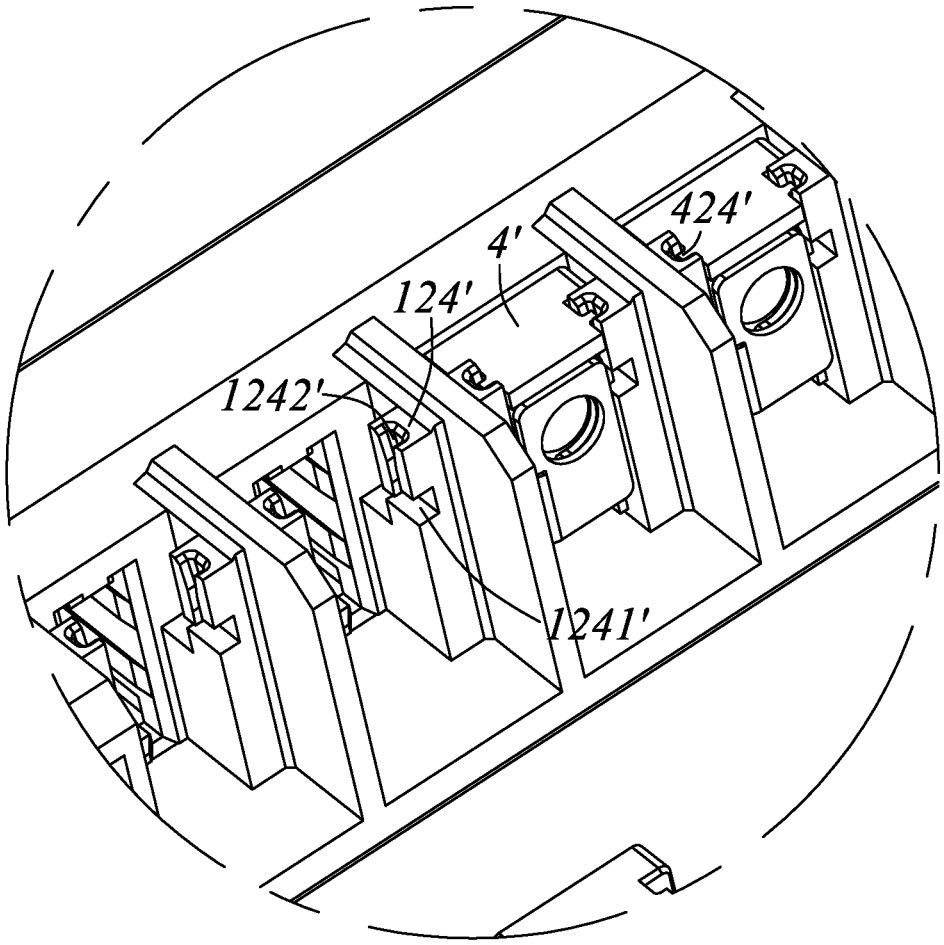
FIG. 12 is an enlarged view of part B in FIG. 11.

FIGS. 11-12 illustrate a second exemplary embodiment of a power connector 100', the insulative housing 1', each power contact pair 2' and each signal contact 3' in the second embodiment have same configurations and assembling relationship as the insulative housing 1, each power contact pair 2 and each signal contact 3 in the first embodiment. Each limiting wall 124' also has a latch mechanism locking with the corresponding bump 421', and a latching slot 1241' is extending along the front-and-back direction and served as the latch mechanism, so the description for them is omitted here for the second embodiment.

In the second exemplary embodiment, each parallel fastener 4' is similar as the parallel fastener 4 in the first exemplary embodiment, and the difference therebetween is described as below: The protrusion 42' of each parallel fastener 4' defines a pair of ribs 424' on both sides thereof, and the ribs 424' are extruding outwards from the relative side face along the transverse direction. The ribs 424' are extending along a fixing direction of the parallel fastener 4' and connected with a relative bump 421', the bump 421' is located on a free end of the corresponding rib 424' to form a hook. Each limiting wall 124' has a positioning slot 1242' extending along a vertical direction and in cross communicated with a latching slot 1241', and the relative rib 424' is received in the positioning slot 1242'. In assembly, the ribs 424' and the bumps 421' of the parallel fastener 4' are inserted into the relative positioning slots 1242' along the up-to-down direction, until the bumps 421' sliding into and locked with the relative latching slot 1241'. Thus the parallel fastener 4 can be held in the insulative housing 1' stably to form a multi-position and multi-directional fixation, and the force points can be dispersed when a large pulling force exerting.

Figure 13:
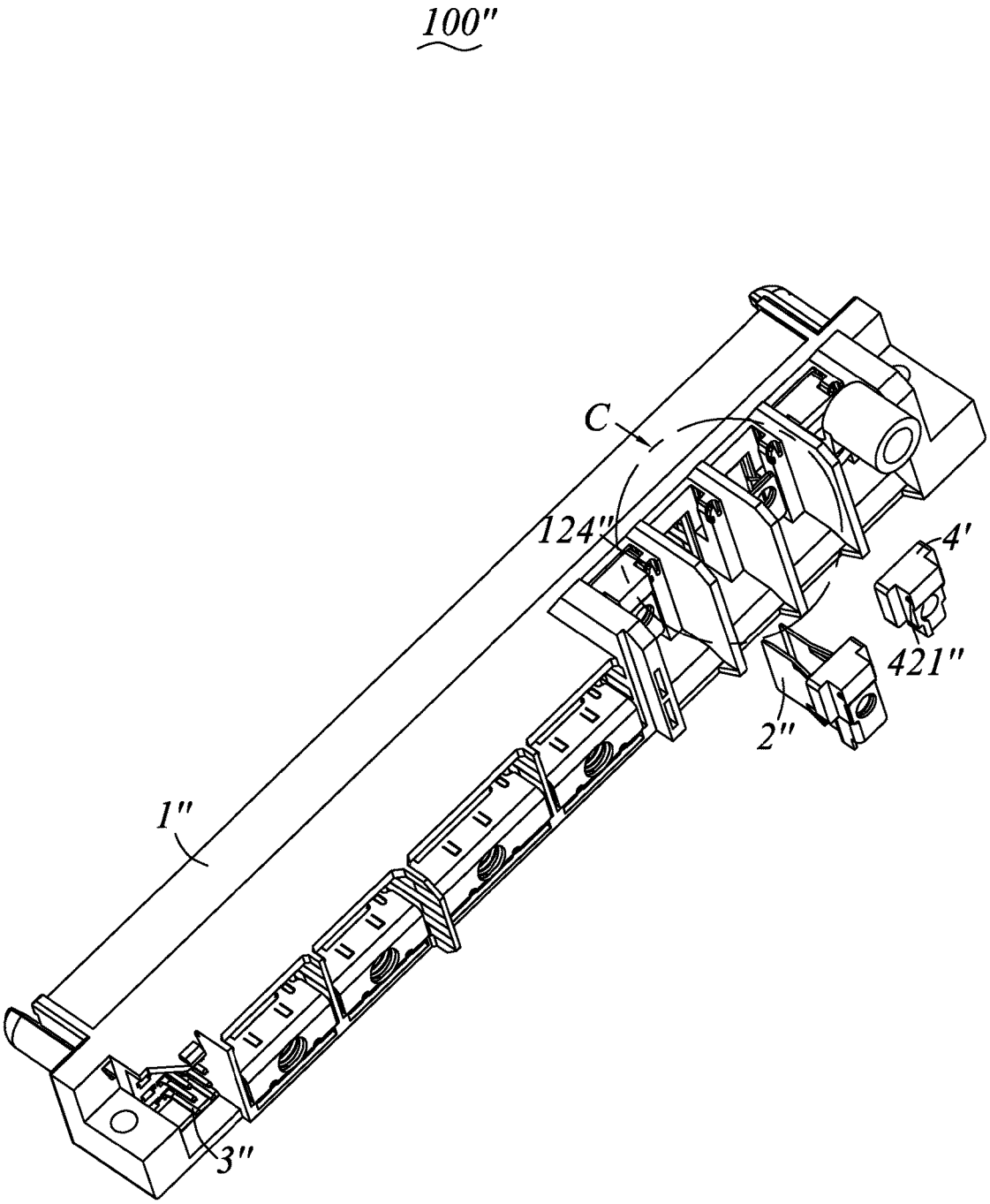
FIG. 13 is a perspective view of a power connector in accordance with a third illustrated embodiment of the present invention.
Figure 14:
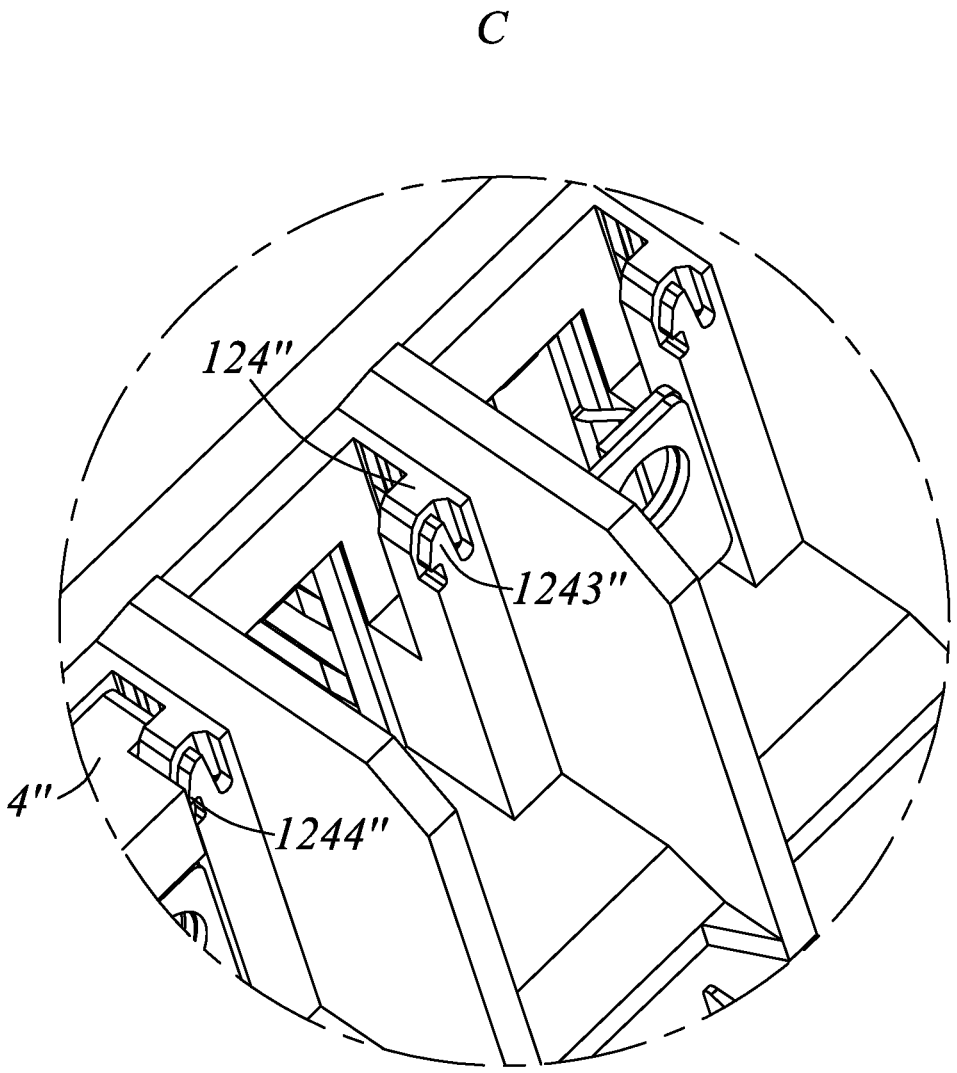
FIG. 14 is an enlarged view of part C in FIG. 13.

FIGS. 13-14 show a third exemplary embodiment of a power connector 100", and an insulative housing 1", each power contact pairs 2", each signal contact 3" and each parallel fastener 4" of the power connector 100" are similar as that of the first exemplary embodiment respectively, so they are no need detailed description here. Each limiting wall 124" also has a latching mechanism locked with the corresponding bump 421", and the difference between the third exemplary embodiment and the first exemplary embodiment is described as below: An elastic arm 1243" is extending along a fixing direction of the parallel fastener 4" and served as the latching mechanism. The elastic arm 1243" is a cantilever structure with a lower end thereof connecting the limiting wall 124", and an upper end of the elastic arm 1243" is a free end, a hook structure 1244" is defined on the free end and locking with the corresponding bump 421". By setting the elastic arm 1243", the buffer space of the parallel fastener 4" during assembly is increased, so as to prevent the limiting wall 124" from generating strong interference and improve the stability of the power connector 100".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector, comprising:

an insulative housing having a plurality of receiving slots arranged side by side along a transverse direction;

a plurality of power contact pairs retained in the insulative housing abreast along the transverse direction, and each power contact pair having a pair of power contacts opposite to each other; and a plurality of parallel fasteners, and each parallel fastener connecting the pair of power contacts of each power contact pair mechanically and electrically together;

wherein the insulative housing defines a plurality of accommodating grooves, and each accommodating groove is located behind and communicated with the corresponding receiving slot, each parallel fastener is locked in the corresponding accommodating groove, and fixing the corresponding power contact pair in the accommodating groove, each parallel fastener has a main portion and a protrusion extruding backwards from the main portion, and the protrusion has a smaller width than the main portion along the transverse direction.

2. The power connector as claimed in claim 1, wherein each power contact pair has a pair of contacting sheets opposite to each other, a rear supporting portion and a pair of conjoining portions connecting the corresponding contacting sheet with the supporting portion respectively, the supporting portion is connected with each conjoining portion to form an L-shaped structure.

3. The power connector as claimed in claim 2, wherein the contacting sheets of each power contact pair are located in the relative receiving slot, the conjoining portions and the supporting portion are received in the relative accommodating groove, the relative parallel fastener is abutting against an upper surface of the pair of the conjoining portion.

4. The power connector as claimed in claim 1, wherein the insulative housing has a mating surface, a rear face and a mounting surface between the mating surface and the rear face, the insulative housing comprises a plurality of partition walls located between the mounting surface and the rear face and arranged separating from each other along the transverse direction, a pair of limiting walls are protruding towards each other from two opposite faces of each two neighboring partition walls, each accommodating groove is formed by two relative limiting walls, the relative mounting surface and two neighboring partition walls fencing together.

5. The power connector as claimed in claim 4, wherein two opposite limiting walls are located on lateral sides of the corresponding protrusion along the transverse direction, thereby locking with the protrusion.

6. The power connector as claimed in claim 4, wherein a pair of bumps are projecting outwards from relative lateral surface of the protrusion, and each one of the pair of limiting walls defines a latch mechanism locking with the corresponding bump.

7. The power connector as claimed in claim 6, wherein a latching slot of each limiting wall is extending along a front-and-back direction and served as the latch mechanism.

8. The power connector as claimed in claim 7, wherein the protrusion of each parallel fastener defines a pair of ribs on both sides thereof, and the ribs are extruding outwards from the relative side face along the transverse direction, the ribs are extending along a fixing direction of the parallel fastener and connected with a relative bump, each limiting wall has a positioning slot for the rib and the bump being inserted into, and the rib is received in the relative positioning slot.

9. The power connector as claimed in claim 6, wherein an elastic arm is extending along a fixing direction of the parallel fastener 4" and served as the latching mechanism.

10. The power connector as claimed in claim 8, wherein each positioning slot is extending along a vertical direction and in cross communicated with the relative latching slot.

11. The power connector as claimed in claim 2, wherein the protrusion has a flange on an upper side of a rear face thereof, and the flange is extending along the transverse direction and located on the supporting portion to prevent the supporting portion moving upwards.

12. The power connector as claimed in claim 11, wherein the protrusion has a convex portion on the rear face further, and the convex portion is received in an indentation of the supporting portion.

13. A power connector, comprising:

an insulative housing having a plurality of receiving slots abreast arranged along a transverse direction and a plurality of accommodating grooves, and each accommodating groove located behind and communicated with the corresponding receiving slot;

a plurality of power contact pairs assembled into the relative receiving slot along a first direction; and a plurality of parallel fasteners assembled into the corresponding accommodating groove along a second direction perpendicular to the first direction, each parallel fastener locked in the corresponding accommodating groove and abutting against the corresponding power contact pair to prevent the power contact pair being pulled up and avoid deformation.

14. The power connector as claimed in claim 13, wherein each power contact pair has a pair of contacting sheets opposite to each other, a rear supporting portion and a pair of conjoining portions connecting the corresponding contacting sheet with the supporting portion respectively, the supporting portion is connected with each conjoining portion to form an L-shaped structure.

15. The power connector as claimed in claim 14, wherein each parallel fastener is abutting against an upper surface of the pair of the conjoining portions, and a rear surface of the parallel fastener is abutting against a front surface of the supporting portion, a flange of the parallel fastener is located on the supporting portion.

16. The power connector as claimed in claim 13, wherein the insulative housing comprises a plurality of partition walls arranged separating from each other along the transverse direction, and a pair of limiting walls are protruding towards each other from two opposite faces of each two neighboring partition walls for locking with the relative parallel fastener.

17. The power connector as claimed in claim 16, wherein a pair of bumps are projecting outwards from relative lateral surface of the parallel fastener, and each one of the pair of limiting walls defines a latch mechanism locking with the corresponding bump.

18. A power connector, comprising:

an insulative housing having a plurality of receiving slots abreast arranged along a transverse direction;

a plurality of power contact pairs assembled into the corresponding receiving slots, each power contact pair has a pair of contacting sheets opposite to each other, a rear supporting portion and a pair of conjoining portions connecting the corresponding contacting sheet with the supporting portion respectively; and a plurality of parallel fasteners abutting against the relative power contact pairs and locking with the insulative housing for retaining the power contact pairs in the relative slots;

wherein each parallel fastener has a main portion, a protrusion extruding backwards from the main portion and an inserting portion below the main portion and the protrusion, the inserting portion has a smaller width than the main portion and the protrusion along the transverse direction for inserting into a space room of the pair of conjoining portions.

19. The power connector as claimed in claim 18, wherein a linking face is formed on a conjunction area between the inserting portion connecting with the main portion and the protrusion, and the linking face is facing downwards to abut against an upper surface of the pair of the conjoining portions.

20. The power connector as claimed in claim 18, wherein the protrusion has a flange on an upper side of a rear face thereof, and the flange is located on the supporting portion.

* * * * *